United States Patent [19]

Peterson

[11] Patent Number: 4,921,234

[45] Date of Patent: May 1, 1990

[54] JAW EXTENDER FOR A BEAM CLAMP

[76] Inventor: Donovan J. Peterson, 2835 N. Watts, Portland, Oreg. 97217

[21] Appl. No.: 229,306

[22] Filed: Aug. 8, 1988

[51] Int. Cl.[5] ..... B25B 1/02

[52] U.S. Cl. ..... 269/147; 269/88; 269/246

[58] Field of Search ..... 269/147, 9, 88, 146, 269/148, 149, 165, 166, 167, 203, 246, 250, 252

[56] References Cited

U.S. PATENT DOCUMENTS

| | | | |
|---|---|---|---|
| 496,168 | 4/1893 | Port . | |
| 612,415 | 10/1898 | Hanson . | |
| 661,488 | 11/1900 | Broadbooks | 269/147 |
| 792,758 | 6/1905 | Colt | 269/147 |
| 1,009,609 | 11/1911 | Wenneborg, Jr. . | |
| 1,188,332 | 6/1916 | Sharp . | |
| 1,642,829 | 9/1927 | Ryden et al. | 269/147 |
| 4,339,113 | 7/1982 | Vosper | 269/147 |

FOREIGN PATENT DOCUMENTS

| | | | |
|---|---|---|---|
| 204304 | 4/1939 | Switzerland | 269/147 |

*Primary Examiner*—Judy Hartman
*Attorney, Agent, or Firm*—Bruce J. Ffitch

[57] ABSTRACT

In a beam or pipe clamp, each of a pair of clamp jaw extenders is loosely coupled to a basic clamp jaw member and threaded onto the beam of the clamp so that the extenders oppose each other, between the basic jaws. Extender form may be chosen to provide greater capacity in terms of a deeper thrust between the clamp jaws or accommodation for irregularly shaped workpieces or both. Fit of the extender on the beam controls extender alignment relative to the beam and ensures that, while the basic jaw member may receive axial clamping forces, "tipping" force imposed on the extender is transferred directly to the beam.

16 Claims, 2 Drawing Sheets

JAW EXTENDER FOR A BEAM CLAMP

BACKGROUND OF THE INVENTION

The invention concerns shifting jaw clamping tools such as vises and beam or pipe clamps and, more particularly, means for extending the jaws of a clamping tool to accommodate larger workpieces.

It is of course well known to provide a range of tool sizes to suit the work in hand. But for many users it is not cost effective to purchases several sizes of tool. Larger sizes, particularly, may be needed too infrequently to justify their purchases.

Adapters for vise jaws are well known. They may modify the jaws to avoid marring the workpiece, or to grip particular shapes. Some adapters may also increase effective throat depth. But, in general, these known adapters mount directly on existing jaw members and must fit closely for stability, so that they must be specific to particular tool models or brands.

The well known beam or pipe clamp offers some opportunity for economy. The basic elongated frame member may simply be a piece of standard weight black pipe of selected length. Onto this pipe may be assembled any one of a range of pairs of jaws of a size suitable to the job on hand. With the pipe clamp, a shift in size does not require a complete new tool, but, again for many users the purchase of a range of clamp jaw sizes still cannot be justified. The frequent particular need is for a jaw configuration of greater depth and more capacity or more accommodating to irregular shapes. The larger work is often relatively light so that the strength of the regular commercial larger size of clamp is not needed. Jaw adapters or extenders for beam clamps are not known.

SUMMARY OF THE INVENTION

Accordingly, an object of the invention is to provide a clamping tool system which has the capability of accommodating a relatively wide range of size and shape of workpiece at a potential cost considerably lower than that of conventional means.

Another object of the invention is to provide a low cost and convenient means of adapting conventional pipe or beam clamps to provide a deeper throat and more capacity for irregular workpiece shape.

A feature of the invention is to provide capacity for larger size work without the duplication of the main frame member of the clamping device (pipe or beam), and without replacement of the existing jaw members.

According to the invention, at least one clamp jaw extender or adapter is placed between the jaws and engaged by an existing jaw so that, in operation, a clamping force is applied to the extender by normal actuation of the tool. Preferably the extender is loosely coupled with the jaw member so that, when the jaw member moves, in either direction, the extender stays with it.

It is a feature of the invention that, even though it may be coupled with an existing jaw member, the extender so engages a main axially extending member of the tool that, in operation, tipping or bending forces are resisted or absorbed largely by that member rather than the regular jaws. And the extender is held erect or aligned by virtue of its engagement with the axial member rather than relying on an engagement with the jaw, so that coupling of the extender with the jaw may be quite loose.

The design of pipe or beam clamps is broadly standardized so that a single design of clamp jaw extender may be compatible with the clamp hardware of a number of manufacturers. Typically, the clamping faces of the jaws of a pipe clamp are flanged in a plane approximately perpendicular to the longitudinal axis of the pipe. The clamp jaw extender may be provided with a socket or groove for engaging this flange or a part of it before threading both the adapter and the jaw member onto the pipe.

It is convenient to use the term "extender" in this discussion but the extender is only a particular form of adapter. The concept of the invention may be applied to providing adapters for purposes other than increasing capacity, such as modifying the clamping surface to grip particular shapes. And variations on the extender as extender are also possible - for example a "C" clamp version to accommodate bulky work.

DESCRIPTION OF THE PREFERRED EMBODIMENT

Figure 1:
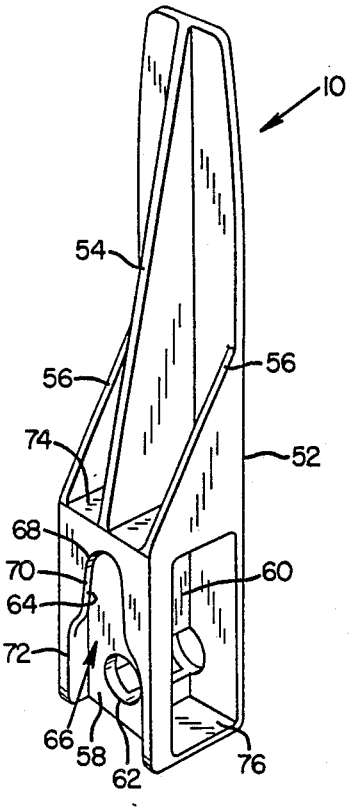
FIG. 1 is a rear three-quarters perspective view of a beam clamp extender according to the invention.
Figure 2:
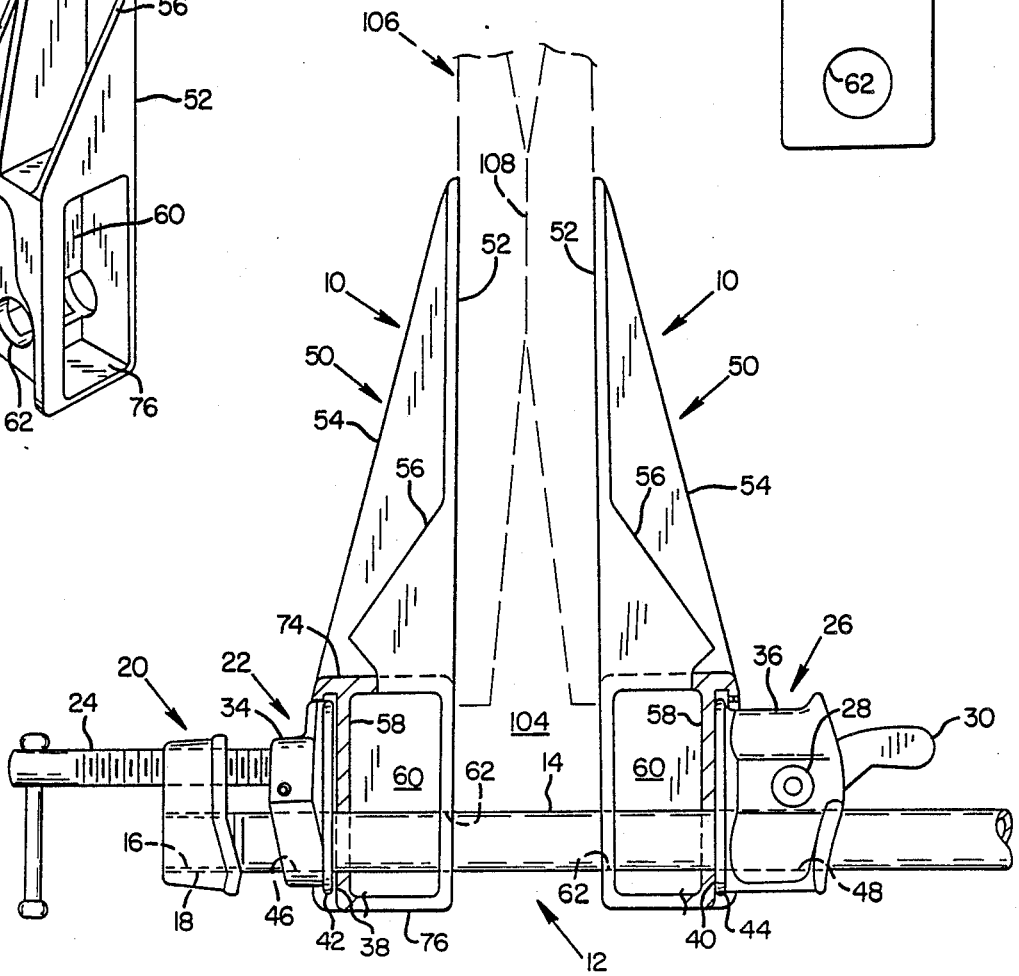
FIG. 2 is a side view of a complete beam clamp assembly including a pair of the extenders of FIG. 1.

The invention is embodied in the pipe clamp adapter 10 shown in FIG. 1 and in the combination of FIG. 2 which includes two pipe clamp adapters 10 and a generally conventional pipe clamp assembly 12.

The general form of the pipe or beam clamp assembly 12 is well known and will be described only briefly here. Its elongated main frame or guide beam 14 is typically tubular, standard pipe often being used. A user may keep pipes of several lengths on hand, selecting a suitable length for a particular job. A threaded portion 16 at one end of the frame member 14 is screwed into the threaded bore 18 of clamp anchor member 20. A first clamp jaw member 22 is axially adjustable on the beam 14 responsive to rotation of the lead screw 24 with the anchor member 20 acting as a "nut" for the lead screw.

A second clamp jaw 26 is roughly positioned on the beam 14 as required and locked into position or anchored by means of a locking cam 28 actuated by lever 30.

Figure 7:
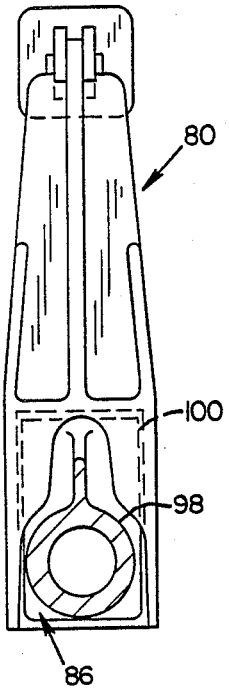
FIG. 7 is a view taken approximately on line 7—7 of FIG. 5 showing the "fit" of the clamp jaw flange and body in the extender socket.

The "working ends" of the first and second clamp jaws 22, 26 are similar in form. A similar form is found in the clamp jaws of a number of competing manufacturing so that in this respect pipe clamp hardware is almost standardized. The present invention takes advantage of this near standardization. The common factors are a body 34, 36 of somewhat pear-shaped cross section (see the outlines in FIG. 7) fronted by a (working) jaw or clamping face 38,40. These faces are larger than the bodies of the jaw members so that the bodies are at least partially surrounded by flanges 42, 44. The bodies 34, 36 are of course bored, 46, 48 for threading onto the beam 14.

Each adapter 10 is preferably a unitary structure or body 50, with an extended clamping face 52, reinforced in its outer portion by one central and two flanking webs 54, 56, respectively. The adapter clamping face 52 in total forms a front wall for the adapter body 50. A lower or inner box-like portion of the adapter includes a rear wall 58 spaced from the front wall (52) by a central web 60 which is interrupted by the passage of a through bore 62 through which the beam 14 is threaded. The rear wall 58 cooperates with a socket flange 64, parallel to and spaced from it, to define a generally downwardly open socket 66 for receiving the flange (42, 44) of a clamp jaw member (22, 26). The socket flange wall 64 has a contoured, somewhat keyhole shaped opening 68, including a relatively narrow upper portion 70 and a broader lower opening 72, the opening being generously dimensioned to accommodate various shapes and sizes of clamp jaw bodies, such as the bodies 34, 36 in this combination. Similarly, the spacing between the rear wall 58 and the socket flange 64 amply accommodates clamp jaw flanges, such as flanges 42, 44 in this combination. The structure of the box-like portion of the adapter body 50 is completed by an upper transverse wall 74, which also closes the top of the socket 66, and a transverse bottom wall 76.

Figure 4:
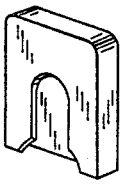
FIG. 4 is a perspective view of a protective cover for the end of the extender of FIG. 1.
Figure 3:
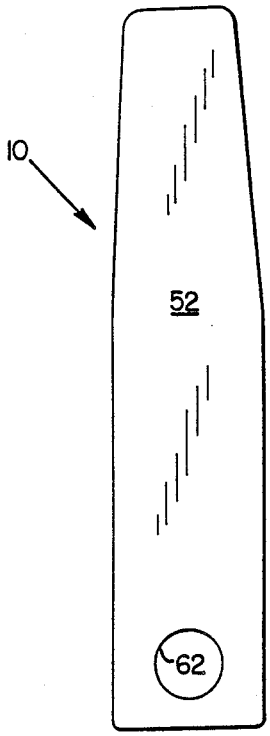
FIG. 3 is a view of the clamping face of the extender of FIG. 1.

FIG. 4 shows a protective sleeve which may be pushed on to the outer end of either the regular jaw flange 42, 44 or the extender face 52.

Figure 5:
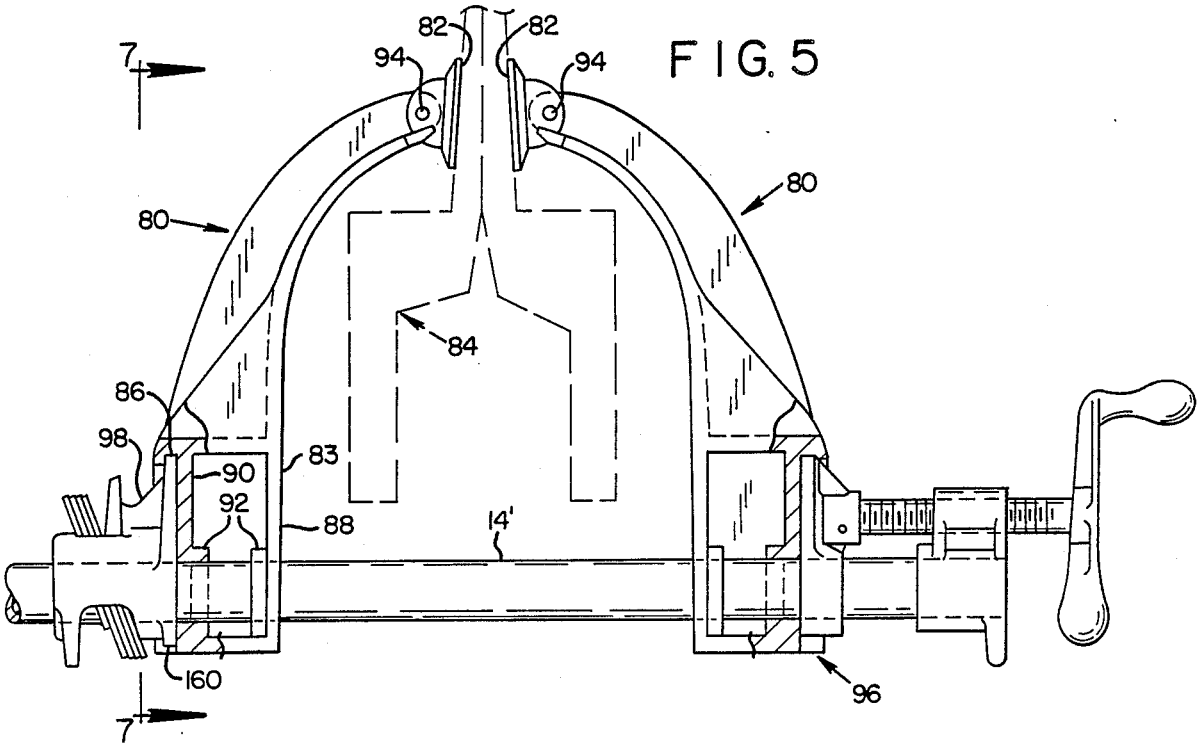
FIG. 5 is a view similar to FIG. 2 of a second beam clamp assembly including a pair of "C" clamp extenders representing a second embodiment of the invention.

FIG. 5 illustrates a second embodiment of the invention which includes a pair of pipe clamp extenders or adapters 80, whose curved form offsets the working clamping faces 82 from their inner or lower front sides 83. This provides a "reach" which may accommodate irregularly shaped workpieces, such as workpiece 84, shown in phantom outline. The general form of the adapter/extenders 80 is similar to that of the straight versions 10 of the first embodiment, and includes a rear socket 86. Lower front and rear walls 88, 90, respectively are optionally embossed (bosses 92), to increase the effective bearing area between the extender 80 and the clamp beam member 14'. In this embodiment the clamp faces 82 are of relatively small area to maximize the usefulness of this configuration in accepting irregularly shaped pieces. Their utility may be further enhanced by making the clamp faces pivotable, as with pivot 94, so that they may conform to a contoured work surface.

The second version of pipe clamp assembly 96 shown in FIG. 5 differs in some details from the assembly 12 of the first embodiment, but again has a jaw member body shape 98, and clamping face flanges 100 readily accommodated in the socket 86 of the extender 80.

Although pipe clamp extenders or adapters according to the invention may take many forms, some description of the operation of the embodiment of FIGS. 1 and 2 along will be sufficiently representative.

When the need for extending or modifying the clamping jaw faces 38, 40 of the existing jaw members 22, 26 is recognized, the pipe clamp assembly 12 is a disassembled to the extent of removing the beam member 14. Before reassembly, the flanges 42, 44 of the jaw members 22, 26 are engaged in the sockets 66 of the extenders 10. The pipe clamp assembly 12 is then reassembled in the normal way, essentially by threading the pipe member 14 through the bores in the respective jaws members and extenders, and reengaging the pipe 14 with anchor member 20.

The elongated extenders 10 create a very deep throat 104 between their opposed parallel clamping faces 52. These elongated parallel faces provide for extended contact between clamping face and workpiece such as the workpiece 106 shown here in phantom outline. In the example shown the extended contact provides stability for the work-piece portions (a glueing operation is assumed), and the much extended reach of the clamping faces 52 allows application of pressure to the workpiece where it is needed-centered on joint 108.

It is a feature of the invention that although the extenders 10 are coupled to their existing clamp jaw members 22, 26 by engagement of their respective sockets and flanges, the engagement is loose and its function is broadly "positional". The extenders are maintained in rotational alignment with their respective existing jaw members and the coupling, of course, determines the axial position of the extender on the pipe 14. Each extender moves axially with the existing jaw member to which it is coupled.

Figure 8:
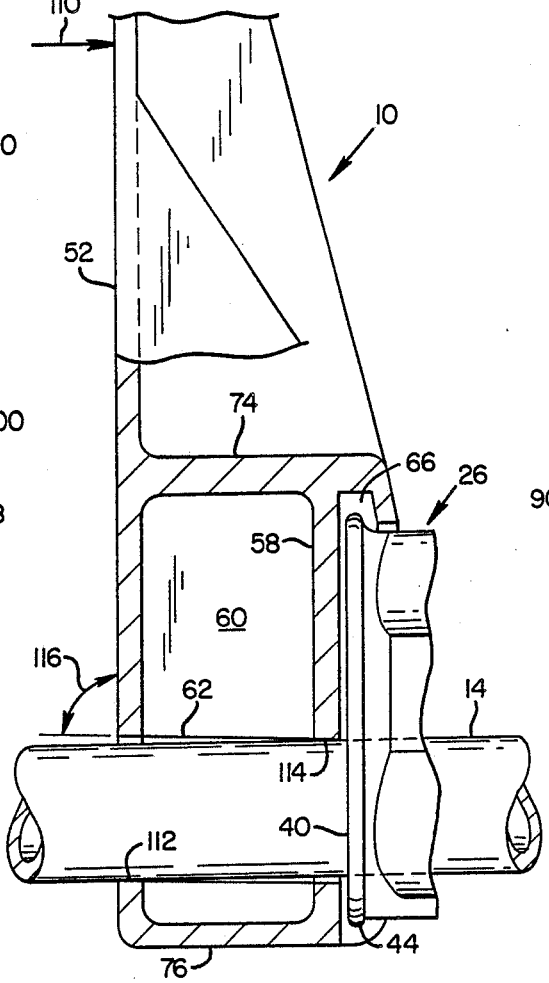
FIG. 8 is an enlarged partial cross sectional view in an upright plane of the longitudinal center-line of the clamp assembly of FIG. 2, showing the clamp beam, clamp jaw and clamp extender relationship.
Figure 6:
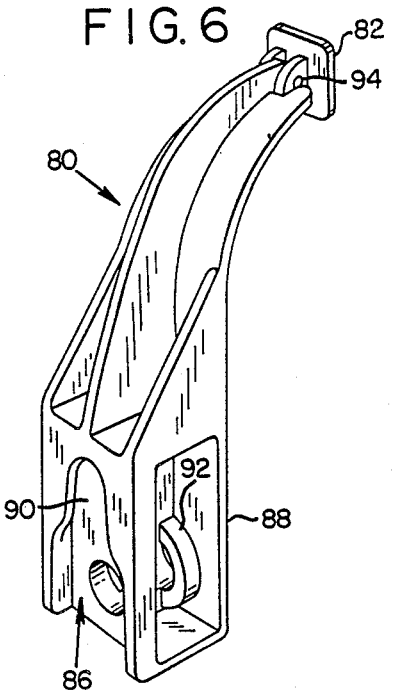
FIG. 6 is a view similar to FIG. 1 of the extender of FIG. 5.

Maintenance of a generally perpendicular alignment of the extenders 10 with respect to the pipe 14 and transmission of clamping forces into the pipe depend mainly on the direct engagement between the pipe 14 and the extenders at their bores 62. As indicated in FIG. 8, a clamping force exerted on a workpiece imposes a corresponding tipping or separating force 110 on extender 10. This force is resisted by the pipe 14 where it is contacted by the extender 10 at axially spaced locations 112, 114. There must of course be significant clearance between the outside diameter of the pipe 14 and the inside of bore 62 to allow for manufacturing tolerances and facilitate assembly. So that, in operation, the clamping face 52 may be held closely perpendicular to the pipe 14 (and the faces 52 of opposing extenders held parallel), the line of the bore 62 may be made at an angle 116, less then 90° to face 52, so that in clamping operation, when the "tipping" slack is taken up, the desired alignment is obtained. The length of the bore 62 is also significant in determining the "sit" of the extender 10 on the pipe 14. A longer bore will make the extender less sensitive to variations in the diameters of the bore and pipe. Too long a bore may be inconvenient as well as costly. Ratios of bore length to diameter of about 1½ to 2 have given good results.

FIG. 8 emphasizes the relatively loose fit of the flange 44 in the socket 66. Axial clearance is shown between the face 40 of the fixed jaw 26 (right-hand jaw in FIG. 2) and the wall 58 of the extender 10. This condition may occur when the extender 10 is "tipped" early in the clamping action and erected into its upright position (as shown in FIG. 8) and the extender "binds" on the pipe 14 before the axial slack is taken up. The movable (left-hand) jaw 22 will, of course, generally take up its axial slack in the action of bringing the clamp jaws together, ready to engage the workpiece.

Clamp jaw adapter/extenders according to the invention are versatile. In the drawings (FIGS. 2 and 5), the extenders are shown only in matched pairs. But certain jobs may be better handled to mixed pairs. For example, a "C" clamp extender 80 may be paired with a straight extender 10 (not shown together). Or, extenders of different reaches or sizes may be used together.

It is feasible to make and use extenders which multiply the reach of the standard clamp jaws six or seven times. For example, options for a pipe clamp assembly based on ¾ inch pipe, having a regular throat depth of 1½ inches, may include adapters providing throat depths of 6½ inches and 10½ inches.

In addition to the above suggested mixes of size and reach of the two embodiments of extender shown (10, 80), a plain or straight adapter (10) may be matched with a profiled adapter (for example, having a clamping face with a groove for fixing a part location in an assembly—not shown in the drawings).

Clearly such versatility, based on say one given size of regular clamp hardware (12), may be attractive to clamp users such as carpenters, cabinet makers, welders, sculptors, etc. It becomes economically feasible for them to keep on hand the equivalent of several complete variations of clamp for additional cost of only the extenders or adapters. This economy is especially feasible when the larger work is relatively light and undemanding of the clamp structure.

A variety of materials may be used for the adapters, selected according to the requirements of a particular adapter and partly according to the market on which it is targeted. Parts requiring higher strength or toughness may be of high carbon steel or ductile iron, or even of high strength plastic. Adapters of plastic materials may especially suit woodworkers.

The advantage of versatility applies when one set of basic clamp hardware is augmented by a set of adapters of different types and sizes. But adapters according to the invention also have a "universal" aspect - with respect to their compatibility with the clamp designs of different manufactures. By relying on the essentially fixed dimensions of the pipe or beam of the clamp assembly as a prime "reference" and bearing point for the adapter, and using the less uniform clamping face flange only as a "loose" secondary positioning reference, variations between manufactures can be accommodated. Also the concept avoids improperly loading or overloading a regular clamp jaw member of possibly limited strength. An adapter concept which embraces the pipe or beam member o the clamp, has another inherent advantage. The adapter is "captive" on the pipe or beam, making handling more convenient compared with adapters which merely sit as caps on clamp jaws.

A limited number of embodiments and combinations of the invention have been discussed and always in the pipe or beam clamp context. Clearly, within the scope and spirit of the invention, other variations of form and context are possible and fall within the scope of the following claims.

I claim:

1. A jaw adapter for use in combination with a clamp, the clamp including opposing first and second jaws, each of said first and second jaws having a jaw face for at least partial engagement with a workpiece when in operation, and means for relative movement between said jaws so as to grip a workpiece placed between the jaw faces and an elongated guide member extending longitudinally between the jaws, the guide member having a longitudinal axis and guiding and controlling, at least in part, the movement of the jaws relative to each other, each jaw face having a reach in a first direction with respect to the guide member longitudinal axis and, in operation, the jaw adapter being interposed between the jaws and comprising:

a body;

coupling means on the body to removably attach said body to one of said jaws for movement therewith.

means carried by the body for directly engaging the elongated guide member so as to maintain the adapter at a substantially fixed angle with respect to the guide member longitudinal axis; and Ser. No. 07/229/306 a jaw adapter face carried by the body, the adapter being associated with the first jaw and disposed so that in operation the jaw adapter face is towards the jaw face of the second clamp jaw, the jaw adapter face having a reach in a first direction with respect to the guide member longitudinal axis substantially greater than the reach of the jaw face of the first jaw.

wherein in operation, with the jaw adapter imposing a gripping force on the workpiece, a tipping load is imposed on the adapter and said tipping load is resisted, at least in part, by the engagement of the through bore of the adapter body with the elongated beam of the clamp

2. The jaw adapter of claim 1 wherein the reach of the adapter face is not less than about three times the reach of the jaw face of the first jaw.

3. A jaw adapter for use with a beam clamp for increasing the workpiece capacity of the clamp, the clamp including an elongated beam of substantially uniform cross section along its length and having a longitudinal axis and first and second jaw members slidably carried by the beam the first jaw member having a flange element lying in a plane approximately normal to the beam longitudinal axis, and each of said first and second jaw members having a clamping face, said faces opposing each other in operation, and means for moving said jaw members together so as to grip a workpiece interposed between said clamping faces, each clamping face extending a first distance from the beam longitudinal axis, in operation the jaw adapter being interposed between the jaws and comprising:

an elongated body having first and second opposite sides and an outer end;

coupling means of the body to removably attach said body to one of said jaws for movement therewith, a clamping face on the face side of the body; and a though bore in the body, approximately normal to the adapter clamping face, the through bore being sized for receiving and directly engaging the beam through said engagement and so as to maintain the adapter in a substantially fixed angular relationship with respect to the longitudinal axis of the beam.

wherein, in operation, with the jaw adapter imposing a gripping force on the workpiece, a tipping load is imposed on the adapter and said tipping load is resisted, at least in part, by the engagement of the through bore of the adapter body with the elongated beam of the clamp

4. The jaw adapter of claim 3 wherein the through bore has first and second opposite ends and the adapter clamping face is substantially coplanar with the first end.

5. The jaw adapter of claim 3 wherein the adapter clamping face is coplanar with the first side of the elongated body.

6. The jaw adapter of claim 3 wherein the adapter clamping face is adjacent the outer end of the body and substantially axially spaced from the first side of the body.

7. The jaw adapter of claim 6 wherein the adapter clamp face is defined by a gripping pad pivotably mounted adjacent the outer end of the jaw adapter body.

8. The jaw adapter of claim 3 and wherein said coupling means is effective between the jaw adapter and the jaw for controlling an axial disposition of the adapter on the beam.

9. The jaw adapter of claim 8 wherein the coupling means comprises a recess in the jaw adapter engageable with the flange element of the first jaw member.

10. The jaw adapter of claim 3 wherein, in assembly, the through bore of the adapter body surrounds the clamp beam so that the adapter is captive on the beam.

11. The jaw adapter of claim 3 wherein the through bore has an effective length and a circular section and the ratio of the length to the diameter of the bore is not less than about 1½ to 1.

12. A deep throated beam clamp arrangement for gripping a workpiece comprising:

an elongated beam of generally uniform cross section along its length and having a longitudinal axis;

first and second jaw members carried by the beam and slidably adjustable along the beam, each jaw member having a clamping face with an outer edge spaced from the beam so as to define a first workpiece throat depth extending in a first direction, and a flange element of the jaw member disposed so that, in assembly, the flange element extends in a plane approximately perpendicular to the longitudinal axis of the beam;

means for adjusting at least one of the jaw members towards the other so as to grip a workpiece interposed between the two jaw members; and a pair of jaw extenders, one each loosely coupled to and axially aligned on the beam with one of the jaw members so that respective extenders and jaw members may move axially in unison on the beam and each of said jaw extenders having an extender elongated body including an clamping face with an outer edge spaced, when in assembly, so as to define a second workpiece throat depth extending in a first direction and significantly greater than the first;

each of said jaw extenders further having a through bore in said body, approximately normal to said extender clamping face, the through bore being sized for receiving and directly engaging the beam through said engagement so as to maintain said extender in a substantially fixed angular relationship with respect to the longitudinal axis of the beam, wherein in operation, with the jaw extenders imposing a gripping force on a workpiece, a tipping load is imposed on said extenders, and said tipping load is resisted, at least in part, by the engagement of the through bore of the adapter body with the elongated beam of the clamp;

13. The clamp arrangement of claim 12 wherein each of said jaw extenders has a recess engageable with the flange element of a jaw member for loosely coupling the extender to the jaw member.

14. The clamp arrangement of claim 12 wherein each of said jaw extender includes an elongated bore for receiving the beam and directly engaging the beam so as to substantially fix the angle of each said relative to the beam.

15. The clamp arrangement of claim 12 wherein said clamping face of each said jaw extender is axially offset from said respective jaw extender through bore;

16. The clamp arrangement of claim 12 wherein each extender clamping face includes a substantially planar portion and the angle between the planar portion and the longitudinal axis of the bore is less than ninety degrees.

* * * * *